US005769325A

United States Patent [19]

Jouillat et al.

[11] Patent Number: 5,769,325

[45] Date of Patent: Jun. 23, 1998

[54] SPRAY NOZZLE AND A SPRAYER INCLUDING SUCH A NOZZLE

[75] Inventors: Claude Jouillat, Montigny-sur-Avre; Olivier de Pous, Paris, both of France

[73] Assignee: Valois S.A., Le Neubourg, France

[21] Appl. No.: 553,711

[22] PCT Filed: May 25, 1994

[86] PCT No.: PCT/FR94/00613

§ 371 Date: Apr. 10, 1996

§ 102(e) Date: Apr. 10, 1996

[87] PCT Pub. No.: WO94/27732

PCT Pub. Date: Dec. 8, 1994

[30] Foreign Application Priority Data

May 28, 1993 [FR] France ..... 93 06404

[51] Int. Cl.[6] ..... A62C 11/00

[52] U.S. Cl. ..... 239/337; 239/463; 239/490; 239/602; 222/333

[58] Field of Search ..... 239/333, 337, 239/463, 464, 490.3, 452, 533.1, 546, 570, 602, DIG. 12; 222/383, 333

[56] References Cited

U.S. PATENT DOCUMENTS

| | | | |
|---|---|---|---|
| 3,586,243 | 6/1971 | Jones | 239/492 |
| 4,082,223 | 4/1978 | Nozawa | 239/333 |
| 4,182,496 | 1/1980 | Burke | 239/492 |
| 4,273,290 | 6/1981 | Quinn | 239/493 |
| 4,613,079 | 9/1986 | Mains | 239/492 |
| 4,650,094 | 3/1987 | Werding | 239/533.1 |
| 4,815,663 | 3/1989 | Tada | 239/493 |
| 4,958,754 | 9/1990 | Dennis | 239/333 |
| 5,181,658 | 1/1993 | Behar | 239/493 |
| 5,197,638 | 3/1993 | Wood | 239/533.1 |
| 5,234,166 | 8/1993 | Foster et al. | 239/333 |
| 5,549,249 | 8/1996 | Foster et al. | 239/463 |
| 5,575,407 | 11/1996 | Foster | 239/493 |
| 5,622,318 | 4/1997 | Bougamont et al. | 239/490 |

FOREIGN PATENT DOCUMENTS

| | | |
|---|---|---|
| 0032541 | 7/1981 | European Pat. Off. . |
| 0117898 | 9/1984 | European Pat. Off. . |
| 0471610 | 2/1992 | European Pat. Off. . |
| 1299607 | 6/1962 | France . |
| 2622478 | 5/1989 | France . |
| 2654078 | 5/1991 | France . |

*Primary Examiner*—Andres Kashnikow
*Assistant Examiner*—Lisa Ann Douglas
*Attorney, Agent, or Firm*—Sughrue, Mion, Zinn, Macpeak & Seas, PLLC

[57] ABSTRACT

A nozzle for spraying a fluid comprises an outlet duct (3, 4) opening out into a swirling chamber (5) in the center of an annular surface (10), the chamber being closed by an end wall (6) which is pierced by an outlet orifice (7) and which includes an inside face (6*a*) provided with swirling grooves (80. The swirling chamber (50 is partially filled by a core (9), the core leaving at least one lateral passage (11) empty, putting the swirling groove into communication with the outlet duct. The spray nozzle also includes a valve adapted to close the outlet duct. The core is a substantially circularly cylindrical elastomer part which is resiliently compressed axially against the end wall (6) of the swirling chamber and the annular surface (10), the core (9) cooperating with the annular surface to constitute the valve, and the core being pressed against the nd wall, thereby isolating the swirling grooves (8) so that they do not communicate with one another between the outlet orifice (7) and the lateral passage (11) left empty by the core (9).

11 Claims, 3 Drawing Sheets

FIG.1
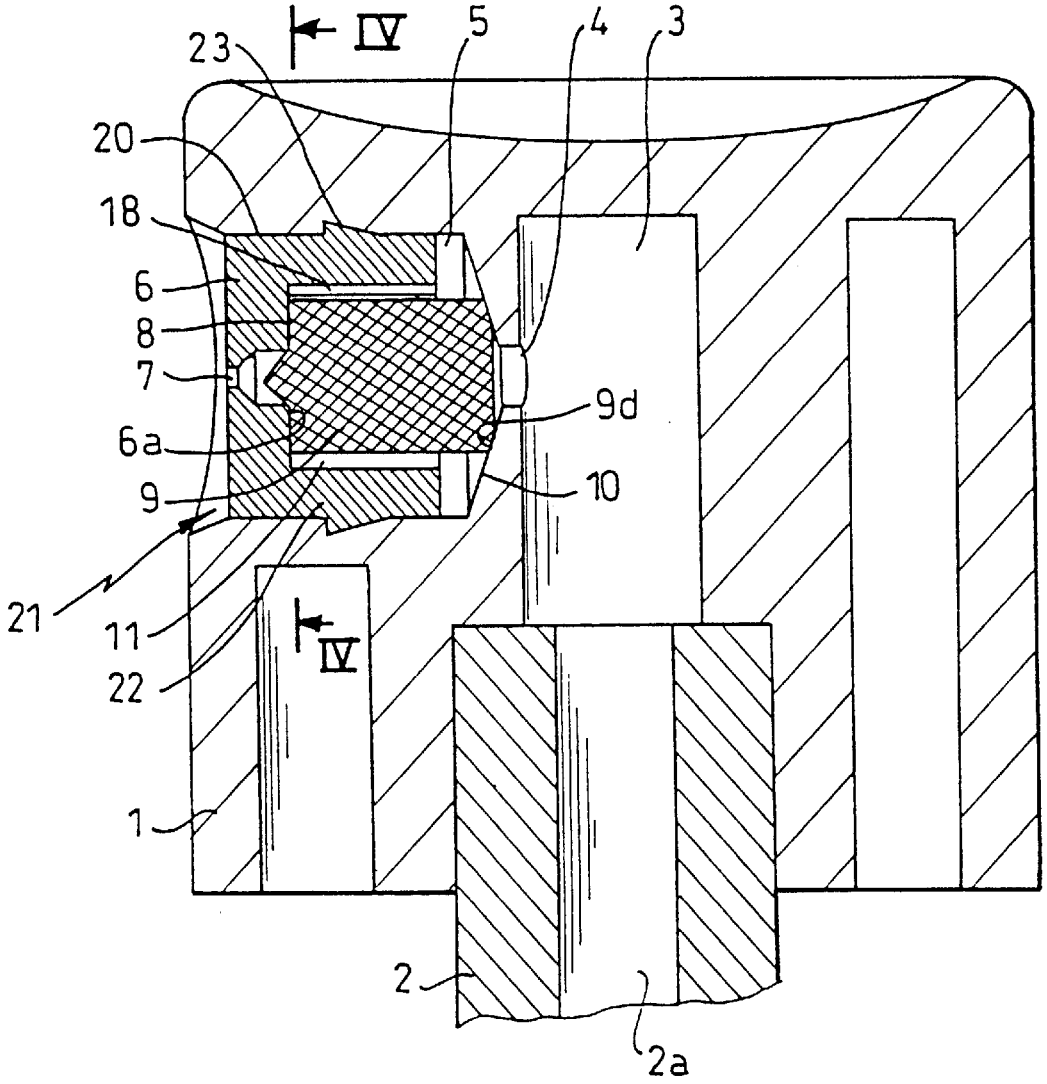
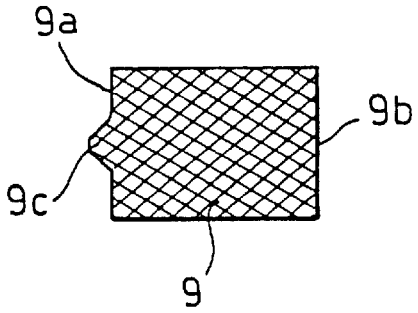
FIG.2
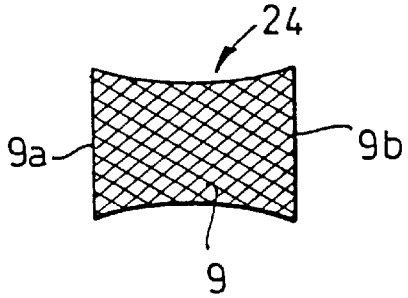
FIG.3

FIG.1a
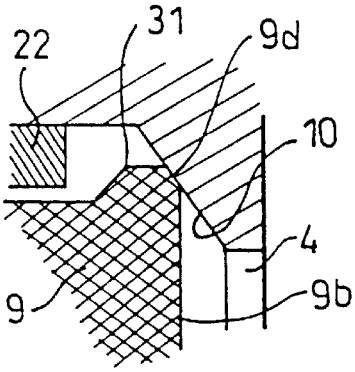
FIG.1b
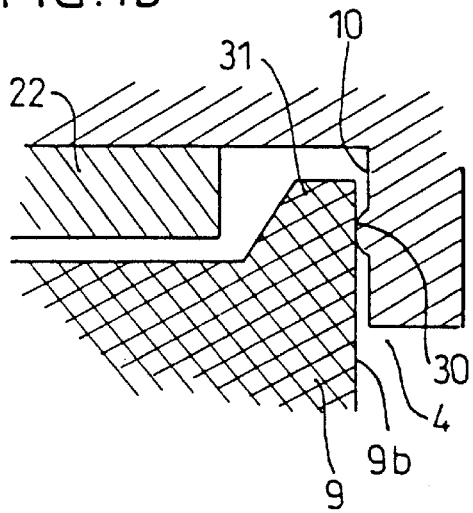
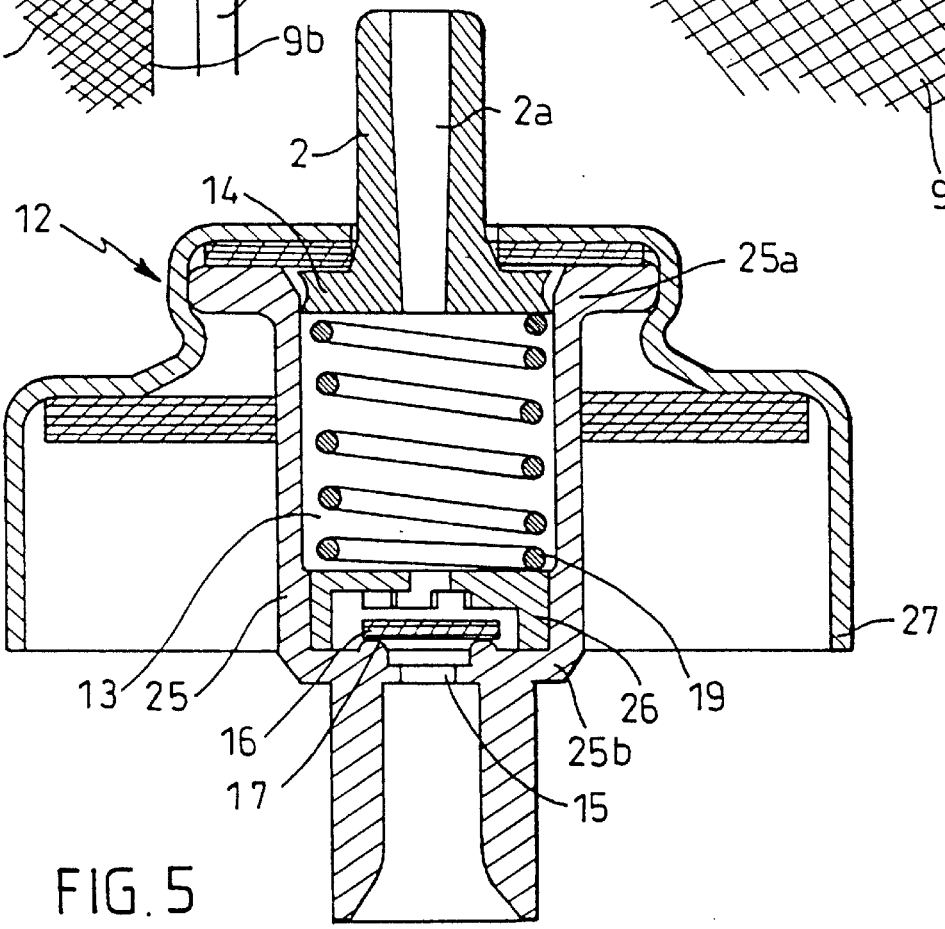
FIG.5
FIG.4
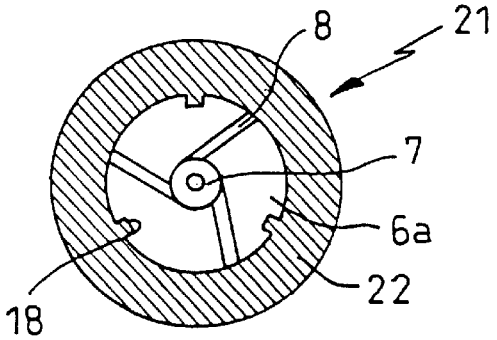

SPRAY NOZZLE AND A SPRAYER INCLUDING SUCH A NOZZLE

BACKGROUND OF THE INVENTION

The present invention relates to a spray nozzle, and to a sprayer including such a nozzle.

Miniaturized sprayers for fluids (liquids or semi-liquids) such as perfumes, cosmetics, or pharmaceuticals, generally comprise a member for controlling emission of the fluid substance (a pump or a valve) that is connected via an outlet duct to a spray nozzle which atomizes the fluid substance into very fine droplets having a diameter of a few tens of microns.

In such sprayers, a known problem is to avoid the fluid drying or oxidizing in the outlet duct between two uses, and also to avoid the fluid seeping out from the spray nozzle between two uses. Document FR-A-2 635 084 teaches solving that problem by using a valve member which closes the outlet duct.

Also, the spray nozzle disclosed in document FR-A-2 635 084 includes, as do many spray nozzles, a swirling chamber closed by an end wall and filled in part by a core. The end wall includes an outlet orifice and non-radial internal grooves converging towards the outlet orifice. The core disposed inside the swirling chamber is generally substantially in contact with the end wall so that the fluid emitted under pressure is constrained to follow the non-radial grooves prior to reaching the outlet orifice. Because of the small section of the grooves, the fluid substance is highly accelerated, and in addition the orientation of the grooves imparts swirling motion thereto such that the fluid is very finely divided when it reaches the outlet orifice.

However, a small gap may remain between the core and the end wall of the swirling chamber, such that the fluid does not pass along the grooves, thereby degrading the quality of the spray. The gap may be due to manufacturing tolerances, to creep of parts made of plastics material, etc.

From documents EP-A-0 117 898 and U.S. Pat. No. 4,273,290, it is known to isolate such grooves by members comprising a valve disk which co-operates with a surface to form an outlet valve and a disk to isolate the grooves at the outlet of the nozzle. The two disks are interconnected by an S-shaped spring which enables the valve disk to move away from its seat under the effect of fluid pressure. Those members thus comprise three distinct elements, namely two disks and one spring, even if the member in document 02 is molded as a single part.

However, the cores disclosed in those documents suffer from the drawback of being difficult to mold because of their geometrical complexity. Also, they leave a large dead volume inside the chamber, thereby leading to the fluid which stagnates therein being spoiled.

SUMMARY OF THE INVENTION

An object of the present invention is to remedy that drawback.

The present invention thus provides a nozzle for spraying a fluid, the nozzle comprising an outlet duct suitable for receiving said fluid and opening out into a distribution chamber in the center of an annular surface, said chamber being closed by an end wall which is pierced by an outlet orifice and which includes an inside face provided with grooves in communication with the outlet orifice, said chamber being partially filled by a core which extends axially between a front face close to the end wall and a rear face remote from the end wall, the core leaving empty at least one lateral passage putting the grooves into communication with the outlet duct, the spray nozzle also comprising a valve adapted to close the outlet duct except during periods when said fluid is being sprayed, and to open under the effect of fluid arriving in the outlet duct, the core co-operating with the annular surface to constitute said valve, said rear face of the core being adapted to bear with sealed contact against said annular surface, the nozzle being characterized in that the core is a substantially circularly cylindrical elastomer part which is resiliently compressed between the end wall of the distribution chamber and said annular surface.

Preferably, the grooves are oriented in non-radial manner relative to the outlet orifice, said front face of the core being pressed against the end wall, thereby isolating the swirling grooves such that the swirling grooves do not communicate with one another between the outlet orifice and said at least one lateral passage left empty by the core, in order to impart swirling motion to said fluid. In this way, the core is kept in contact against the end wall by its own resilience, thereby eliminating the above-mentioned gap, and simultaneously it acts as a valve member for closing the outlet duct. When the fluid arrives under pressure in the outlet duct, the rear face of the core is moved away from its annular thrust surface by axial elastic deformation under the effect of the pressure, thereby pressing the front face of the core even more firmly against the end wall of the swirling chamber.

In addition, because of its simple shape, the core is easy to manufacture. A core of the invention is obtained from a simple elastomer cord of circular section which is cut to the desired thickness. It is easy to match different sizes of swirling chamber by taking a cord of appropriate section from which a slice is cut corresponding to the length of the chamber.

Another advantage of the core of the invention comes from the fact that the core fills the swirling chamber leaving very little dead volume. Thus, the volume of fluid that stagnates in the swirling chamber is small, and as a result there is very little deterioration due to oxidation or drying. The core can be adapted so that it leaves a cylindrical annular lateral passage of very small section.

In one embodiment, the front face of the core includes a projecting portion which penetrates into the outlet orifice. This restricts the dead volume inside the spray orifice.

Advantageously, said annular surface is conical, with its concave side facing the core, and the rear face of the core is circular. The zone in sealed contact between the rear face of the core and the annular thrust surface is then a rather narrow outer annular zone. In a variant, said annular surface is a sealing ridge disposed close to the outside of the rear face of the core.

The core may be molded in thermoplastic elastomer (TPE), thereby facilitating manufacture and making it possible to obtain sufficient flexibility.

Centering means may be provided for positioning the core relative to the outlet duct and to the outlet orifice.

In another embodiment, the core is a disk that is elastically deformable by bending, and that is prestressed between the annular surface and the end wall, the annular contact of said disk with the annular surface being of a diameter that is smaller than the diameter of the contact of the disk with the end wall such that the pressure exerted by the fluid inside the outlet duct deforms the disk by bending its peripherally outer portion, thereby breaking contact with the annular surface. The core is deformed by bending instead of by axial compression. There is a tilting effect under the pressure of the fluid, while still ensuring intimate contact on the swirling channels. This form of core is better adapted to valve members for use with a gel or with a cream, without spraying.

Advantageously, the core may be of narrowed section at an intermediate position along its axial length, thereby giving it greater axial flexibility.

The invention also provides a fluid sprayer comprising a spray nozzle according to any preceding claim, and a pump which comprises:

a cylindrical pump chamber;

a piston which slides in the pump chamber;

an inlet orifice which communicates with the pump chamber via an inlet valve; and a delivery duct which is permanently in communication with the outlet duct of the spray nozzle.

The spray pump is considerably simplified since it no longer includes a delivery valve: it is the core of the nozzle in co-operation with the annular thrust surface that constitutes the delivery valve. Because the core is continuously resiliently compressed, this delivery valve opens only when sufficient predetermined pressure exists in the pump chamber to move it away from its annular thrust surface: the sprayer is thus of the "compression" type and guarantees excellent spraying.

Document EP-A-0 378 935 describes a pump whose delivery valve member is constituted by an axially deformable resilient part disposed in the outlet duct in the vicinity of the outlet orifice. However, that pump does not include a spray nozzle since it is designed to dispense ophthalmological medication in the form of one drop per actuation.

In one embodiment, the piston is controlled by an actuator rod in which the delivery duct is formed, the pump including a spring exerting a return force on the piston, and a pushbutton is mounted on the actuator rod to move the piston against the force of the spring, the pushbutton including said spray nozzle.

BRIEF DESCRIPTION OF THE DRAWINGS

Other characteristics and advantages of the invention appear from the following detailed description of an embodiment of the invention given by way of non-limiting example with reference to the accompanying drawings.

In the drawings:

FIG. 1 is a section view through a pushbutton including a spray nozzle of the invention;

FIGS. 1*a* and 1*b* are detail views of two variants of the FIG. 1 pushbutton;

FIG. 2 is a section view of the core of the spray nozzle of FIG. 1;

FIG. 3 is a section view of a variant of the FIG. 2 core;

FIG. 4 is a section view on line IV—IV of FIG. 1;

FIG. 5 is a section view of a pump on which the pushbutton of FIG. 1 can be mounted.

DETAILED DESCRIPTION OF THE PREFERRED EMBODIMENTS

Figure 6:
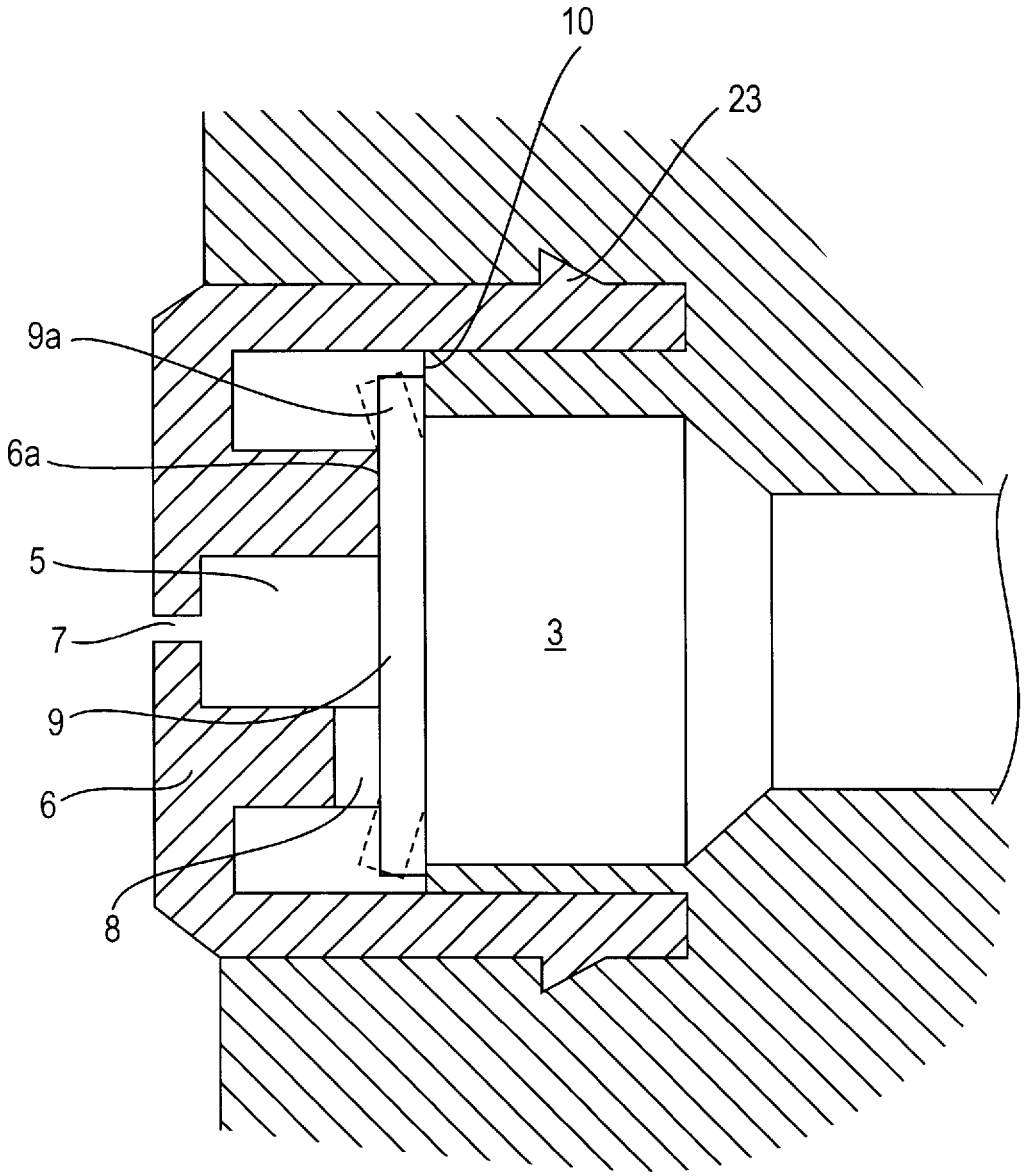
FIG. 6 is a section view of a second embodiment of a spray nozzle made in accordance with the present invention.

FIG. 1 shows a pushbutton 1 adapted to be mounted on an actuator rod 2 of a pump or a valve for dispensing a fluid which may be a liquid or a semi-liquid, such as a perfume, a cosmetic, or a medicine, or some other fluid. The pushbutton 1 forms a portion of a small spray assembly adapted to be held in the hand and enables the pump or valve to be actuated by means of a finger, even though automatic actuation is also conceivable without going beyond the ambit of the invention.

The pushbutton 1 is generally molded in plastics material. It includes a duct 3 in which the actuator rod 2 is engaged. The actuator rod 2 has a central channel 2*a* that enables the fluid to be emitted and that communicates with the duct 3. The pushbutton also includes a swirling chamber 5 which opens out sideways to the outside of the pushbutton. The swirling chamber 5 has a circularly cylindrical side wall 20 and an end wall 10 pierced by a central orifice 4 which communicates with the duct 3. In this case the end wall 10 is conical in shape, with its concave side facing the chamber 5. It should be observed that the chamber 5 could equally well be disposed in line with the duct 3 instead of being disposed laterally.

The chamber 5 receives a socket-shaped part 21 molded out of plastics material and referred to as a spray insert. The insert 21 comprises an end wall 6 and a side wall 22. To prevent the insert 21 from being expelled from the chamber 5 by the pressure of the fluid, it is firmly secured to the pushbutton 1. In the example shown, the side wall 22 of the insert includes an outer annular rib 23 that is barb-shaped and is snapped by force into a complementary groove in the side wall of the chamber 5. The end wall 6 of the insert 21 thus closes the open end of the swirling chamber 5. Nevertheless, the end wall 6 of the insert is pierced by a central outlet orifice 7 of very small diameter, having an enlarged portion that flares towards the inside of the chamber 5. The end wall 6 of the insert also includes an inside face 6*a* in which non-radial swirling grooves 8 are formed that extend between the enlarged portion of the outlet orifice and the outer periphery of the inside face 6*a*. As can be seen in FIG. 4, the grooves 8 are oriented to impart swirling motion to the fluid on arrival in the flared portion of the orifice 7.

With reference again to FIG. 1, an elastomer core 9 is placed in the swirling chamber 5, being resiliently compressed against the end wall 6 of the insert and the end wall 10 of the swirling chamber. The core 9 is advantageously made of thermoplastic elastomer (TPE), e.g. Kraton® (Shell). This type of elastomer has the advantage of accepting considerable elastic deformation and of being suitable for injection molding, thereby facilitating manufacture thereof.

As shown in FIG. 2, the core 9 is a circularly cylindrical part which extends axially between a rear face 9*b* and a plane front face 9*a* that is optionally provided with a central projection 9*c* that penetrates into the enlarged portion of the outlet orifice. In the example shown, the core 9 may typically have a diameter of 2.5 mm to 5 mm, and a length of 3 mm to 10 mm. In special circumstances, its length may possibly go down to 1 mm or up to 20 mm to 30 mm. Nevertheless, these dimensions are given purely by way of non-limiting example.

When the core 9 is mounted in the pushbutton 1, as shown in FIG. 1, the initially plane rear face 9*b* is deformed by elastic compression against the end wall 10 of the chamber 5, with deformation taking place in an outer annular zone 9*d*, thereby guaranteeing excellent sealing. This ensures that the duct 3 is closed between two squirts. Advantageously, as shown in FIG. 1, the annular zone 9*d* does not extend radially all the way to the central orifice 4 so that fluid under pressure coming from the duct 3 exerts its pressure on a maximum area of the rear face 9*b* of the core. As shown in FIG. 1*a*, the core 9 may include an outwardly-directed flange 31 on its rear face 9*b* so as to maximize the area of the rear face 9*b* on which the pressure of the fluid coming from the duct 3 acts. In FIG. 1*a*, the flange 31 is received between a rear end of the side wall 22 of the insert and the end wall 10 of the chamber 5. In a variant, as shown in FIG. 1*b*, the end wall 10 of the chamber 5 may include an annular sealing ridge 30 disposed around the orifice 4 in the vicinity of the outside diameter of the core 9, and against which the rear face 9*b* of the core presses: the fluid under pressure from the duct 3 can thus exert its pressure over the entire area of the rear face 9*b* situated inside the ridge 30. In this variant, the end wall 10 of the chamber 5 may be flat. In addition, the core 9 may also include an outwardly directed flange 31 as in FIG. 1*a*: the ridge 30 is then placed facing the flange 31, thereby further increasing the area of the rear face 9*b* of the core against which the pressure of the fluid from the duct 3 acts.

The front face 9*a* of the core is pressed in sealed contact against the inside face 6*a* of the end wall of the insert, and an annular space 11 is left free between the side wall 22 of the insert and the core 9. Thus, when the fluid is emitted under pressure and penetrates into the duct 3, it pushes away the rear face 9*b* of the core, by causing the core to deform elastically in an axial direction. The fluid then flows towards the annular space 11 and then along the swirling grooves 8 prior to being sprayed through the outlet orifice 7.

The side wall 22 of the insert 21 may optionally include internal axial ribs 18 or other portions in relief for positioning the core 9. In a variant, axial ribs or other portions in relief could be formed on the core 9.

As shown in FIG. 3, in order to increase its axial flexibility, the core 9 may optionally include a central portion 24 of narrower section.

FIG. 5 shows a pump 12 for operating together with the pushbutton of FIG. 1. The pump 12 comprises a pump body 25 molded in plastics material and defining a cylindrical pump chamber 13. The pump chamber 13 extends between an open end 25*a* and an end 25*b* provided with an inlet orifice 15. The inlet orifice 15 communicates with a tank of said fluid (not shown) either directly or else via a dip tube (not shown). A piston 14 molded in plastics material slides inside the pump chamber 13. The piston 14 has an actuator rod 2 which projects through the open end of the pump body and which is pierced by a central channel 2*a* that opens out into the pump chamber 13. The inlet orifice 15 is provided with an inlet valve made up of a valve member 16 of elastomer adapted to bear in sealed manner against a valve seat 17 formed around the inlet orifice 15. The inlet valve allows fluid only to enter the pump chamber 13. The valve member 16 is kept close to the valve seat 17 by a carrier 26.

A helical metal return spring 19 is mounted between the piston 14 and the carrier 26 and it urges the piston 14 towards the open end 25*a* of the pump body. The piston is held inside the pump body 25 by a metal cap 27 crimped onto the pump body and capable of being crimped onto the neck of said tank of fluid.

The pushbutton 1 is mounted on the actuator rod 2. The core 9 and the end wall 10 of the swirling chamber 5 then constitutes the outlet valve of the pump 12.

A second embodiment of a spray nozzle is shown in FIG. 6. Characteristics in common with the first embodiment are not described again and are designated by the same reference numerals. The core 9 is now in the form of a resilient disk made of TPE or of a foam having closed cells. The thickness of the disk is small, and may go down to a few tenths of a millimeter. It is wedged between the annular surface 10 and the inside face 69 of the end wall 6 which includes the swirling channels 8. The disk is thus disposed under prestress in such a manner that the channels 8 are completely isolated from one another. This resilient prestress also serves to provide good sealing at the annular surface 10. In the invention, the annular surface 10 has an inside diameter that is larger than the outside diameter of the inside face 6*a*. Thus, when the fluid is put under pressure in the outlet duct 3, the outer peripheral portion 9*a* of the disk 9 bends towards the swirling chamber 5, as shown in dashed lines in FIG. 6. Contact between the disk and the annular surface is thus broken, thereby establishing a passage for the fluid under pressure. Unlike the first embodiment where the core deforms by axial compression, in this case the disk is subjected to deformation by bending. The core (disk) is thus restricted to a mere slice of flexible elastomer.

This type of thin core is particularly adapted for use in nozzles for dispensing gel or cream without spraying. It also makes it possible to provide nozzles/valves of very small thickness, given its own compactness.

We claim:

1. A nozzle for spraying a fluid, the nozzle comprising an outlet duct (3, 4) for receiving said fluid and opening out into a distribution chamber (5) in the center of an annular surface (10), said distribution chamber being closed by an end wall (6) pierced by an outlet orifice (7) and which includes an inside face (6*a*) provided with grooves (8) in communication with the outlet orifice, said distribution chamber being partially filled by a core (9) which extends axially between a front face (9*a*) close to the end wall and a rear face (9*b*) remote from the end wall, the core leaving empty at least one lateral passage (11) putting the grooves into communication with the outlet duct, the spray nozzle also comprising a valve adapted to close the outlet duct except during periods when said fluid is being sprayed, and to open under the effect of fluid arriving in the outlet duct, the core co-operating with the annular surface to constitute said valve, and said rear face (9*b*) of the core bearing with sealed contact against said annular surface (10), wherein the core is a substantially circularly cylindrical elastomer member which is resiliently and axially compressed between the end wall of the distribution chamber and said annular surface.

2. A spray nozzle according to claim 1, in which the grooves (8) are oriented in a non-radial manner relative to the outlet orifice (7), said front face (9*a*) of the core being pressed against the end wall (6), thereby isolating the swirling grooves (8) such that the swirling grooves do not communicate with one another between the outlet orifice and said at least one lateral passage (11) left empty by the core (9), in order to impart swirling motion to said fluid.

3. A spray nozzle according to claim 1, in which the front face (9*a*) of the core includes a projecting portion (9*c*) which penetrates into the outlet orifice (7).

4. A spray nozzle according to claim 1, in which said annular surface (10) is conical, with a concave side thereof facing the core (9), and the rear face (9*b*) of the core is circular.

5. A spray nozzle according to claim 1, in which said annular surface (10) is a sealing ridge (30) disposed close to an outside of the rear face (9*b*) of the core.

6. A spray nozzle according to claim 1, in which the core is molded in thermoplastic elastomer (TPE).

7. A spray nozzle according to claim 1, in which centering means (18) are provided for positioning the core (9) relative to the outlet duct (3, 4) and to the outlet orifice (7).

8. A spray nozzle according to claim 1, in which the core is a disk (9) that is elastically deformable by bending, and that is prestressed between the annular surface (10) and the end wall (6), the annular contact of said disk with the annular surface (10) being of a diameter that is larger than the diameter of the contact of the disk with the end wall (6) such that the pressure exerted by the fluid inside the outlet duct (3, 4) deforms the disk by bending its peripherally outer portion, thereby breaking contact with the annular surface.

9. A spray nozzle according to claim 1, in which the core is of narrowed section at an intermediate position (24) along its axial length.

10. A fluid sprayer comprising a spray nozzle according to claim 1, and a pump (12) which comprises:

a cylindrical pump chamber (13);

a piston (14) which slides in the pump chamber;

an inlet orifice (15) which communicates with the pump chamber (13) via an inlet valve (16, 17); and a delivery duct (2*a*) which is permanently in communication with the outlet duct (3, 4) of the spray nozzle.

11. A sprayer according to claim 10, in which the piston (14) is controlled by an actuator rod (2) in which the delivery duct (2*a*) is formed, the pump including a spring (19) exerting a return force on the piston (14), and a pushbutton (1) is mounted on the actuator rod (2) to move the piston against the force of the spring (19), the pushbutton (1) including said spray nozzle.

* * * * *